United States Patent [19]

Schliesser

[11] 4,174,913

[45] Nov. 20, 1979

[54] ANIMAL GUARD FOR FIELD PIPE

[75] Inventor: Carroll G. Schliesser, Hicksville, Ohio

[73] Assignee: Myrtle M. Schliesser, Hicksville, Ohio

[21] Appl. No.: 852,518

[22] Filed: Nov. 17, 1977

[51] Int. Cl.[2] ..... E02B 7/20

[52] U.S. Cl. ..... 405/94; 137/527.8

[58] Field of Search ..... 210/131; 137/527.6, 137/527.8; 49/10; 61/25

[56] References Cited

U.S. PATENT DOCUMENTS

| | | | |
|---|---|---|---|
| 999,305 | 8/1911 | Gurnett | 137/527.8 |
| 3,118,469 | 1/1964 | Schliesser | 137/527.8 |
| 3,289,840 | 12/1966 | Kahn | 210/131 |
| 3,445,863 | 5/1969 | Wada | 137/527.8 X |

FOREIGN PATENT DOCUMENTS

| | | | |
|---|---|---|---|
| 81799 | 8/1956 | Denmark | 137/527.8 |

*Primary Examiner*—Theodore A. Granger

*Attorney, Agent, or Firm*—Gust, Irish, Jeffers & Rickert

[57] ABSTRACT

An animal guard for use in a field pipe has a generally circular baffle member formed of relatively thin sheet material mounted for pivotable movement in the direction of effluent flow at a perimetral point inwardly of the pipe at an axial predetermined distance from the open end of the pipe. A stop bar is secured inwardly of the pipe at a distance greater than said predetermined distance so that it is on the opposite axial side of the member. The bar extends from the inner surface of the pipe in a direction inclined in the direction of effluent flow and has a length to restrict pivoting of the member in a second arcuate direction oppositely of the first direction to prevent animal entry past the member while the member is free to pivot in the first direction toward the open pipe end to provide substantially free-flow of debris carrying effluents in the pipe toward the open end, while preventing the entrance of animals into the pipe.

2 Claims, 6 Drawing Figures

ANIMAL GUARD FOR FIELD PIPE

BACKGROUND OF THE INVENTION

1. Field of the Invention

This invention is in the field of animal guards for drain pipes of the kind that prevents animal entry into an open pipe end but provides for free-flow of debris carrying effluents from the open pipe end.

2. Description of the Prior Art

This invention is an improvement over the guard shown in U.S. Pat. No. 3,118,469 entitled "Animal Guard for Tile Drain Pipe" issued to John O. Schliesser, father of the present inventor. In that patent, a guard is disclosed having a generally circular baffle member which is pivotably connected at an upper perimetral point inwardly from the open end of a field pipe and is free to pivot in an arcuate first direction towards the open end and towards the upper pipe surface to provide for substantially free-flow of effluents, which frequently carry debris, towards the open pipe end. A stop member is positioned in the pipe adjacent the baffle member on the side opposite the side facing the open end. The stop member has a pair of outwardly inclined leg portions which engage symmetrically disposed portions of the baffle member on either side of the pivotal point to prevent its pivoting in an arcuate second direction opposite to the first direction so that animal entry past the member is effectively prevented.

While the device of the aforementioned Schliesser Patent has worked satisfactorily in the field for a number of years, it has been found that the stop member, while effectively preventing pivoting of the baffle member to prevent animal entry, tends to collect debris on the outwardly angled depending arms thus blocking free-flow of the effluents, interfering with pivotal baffle member movement, and resulting in corrosion of the stop members due to the trapped debris and continued exposure to the moisture and impurities carried and retained by the debris.

SUMMARY OF THE INVENTION

A generally U-shaped member having inner and outer legs connected by a bight portion is proportioned to fit over an upper wall section of an open pipe end, with the inner and outer legs extending axially of the pipe and respectively engaging the inner and outer surfaces thereof. A generally circular baffle member, formed of relatively thin sheet material, is pivotably mounted adjacent a point on its perimeter to the inner leg inwardly of the open pipe end a predetermined axial distance which is greater than the member diameter. The inner leg is formed with an arcuately rounded indentation to facilitate pivoting of the baffle member.

The baffle member is vertically suspended from the inner leg and a relatively short stop bar is affixed to and depends from the inner leg at a position thereon at an axial distance greater than the predetermined distance from the open end. The bar is of a length and inclination to restrict arcuate pivotal baffle member movement in a direction opposite to the first direction to prevent animal entry past the baffle member. The bar inclination is in the direction of effluent flow and the bar length is relatively short to minimize obstruction to effluent flow. The baffle member is folded along a substantially vertical diameter with the halves on either side of the diameter having an included fold angle which is obtuse and which faces inwardly of the pipe to facilitate pivoting of the member toward the open pipe end.

The free end of the bar has corner portions folded to conform to the angle between the baffle member halves providing stabilizing surface contacts with the respective halves to prevent member pivoting about the vertical diameter during animal entry attempts. Thus, a stop member is provided which not only provides a stable pivotal stop to the baffle member in an animal entry direction, but also has a minimal portion thereon to collect and trap debris since it is relatively short and substantially vertically depends from the pipe wall. The stop member is inexpensive in manufacture and maintenance.

Further, the point on the inner leg at which the baffle is pivoted is rounded to provide free pivoting of the baffle on the leg portion, thus cooperating with the stop bar and providing a reaction point on the baffle member to prevent its pivotal movement in the opposite direction.

Therefore it is an object of this invention to provide an improved animal guard for a field pipe which is economical in construction and maintenance.

It is a further object of this invention to provide in such a guard a baffle plate which is freely pivotable in one direction to provide for free-flow of debris carrying effluent from the pipe but is restricted from pivotal movement in the opposite direction to prevent animal entry past the member, with a minimum of debris trapping structure.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
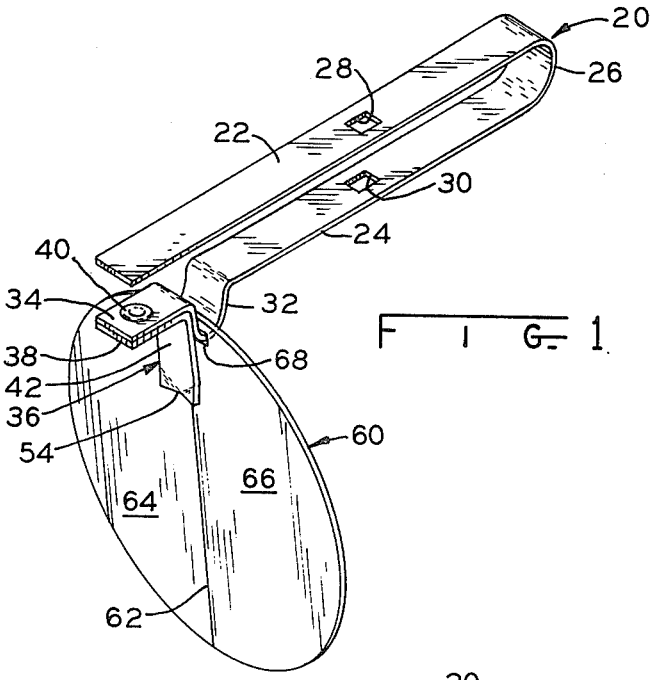
FIG. 1 is a view in perspective of a preferred embodiment of this invention.
Figure 6:
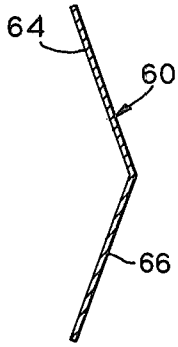
FIG. 6 is a section taken at 6—6 of FIG. 4.

Referring to the drawing, U-shaped retainer 20 has outer leg 22 connected to inner leg 24 by bight portion 26. Leg 22 overlies leg 24 and has opening 28 formed intermediately therein which is in vertical registration with opening 30 in leg 24 for purposes later described. Leg 24 has arcuate indent 32 which is a predetermined distance from bight 26 and is adjacent end 34 of leg 24.

Figure 4:
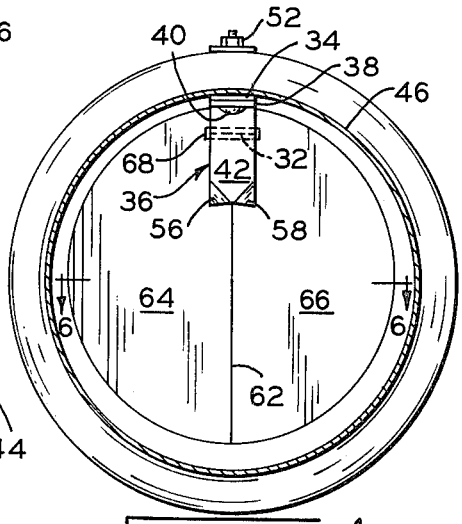
FIG. 4 is a section taken at 4—4 of FIG. 2.

Stop member 36 has horizontal segment 38 which underlies and is attached to end 34, as by rivet 40. Bar 36 is an oblong bar having four corners and has portion 42 which is inclined downwardly toward the axis of corrugated field pipe 44, (FIG. 2) in the direction of effluent flow. Legs 22 and 24 of retainer 20 are slipped over the top center portion of pipe 44 (FIG. 4) and engage respectively the upper and lower extremities of pipe corrugations 46, with bight 26 engaging the end of pipe 44. Hole 48 is formed in a corrugation 46 in alignment with openings 28 and 30 and bolt 50 is inserted through openings 30, 48, and 28, and is threadedly secured by nut 52 thus holding retainer 20 in place on pipe 44.

Figure 2:
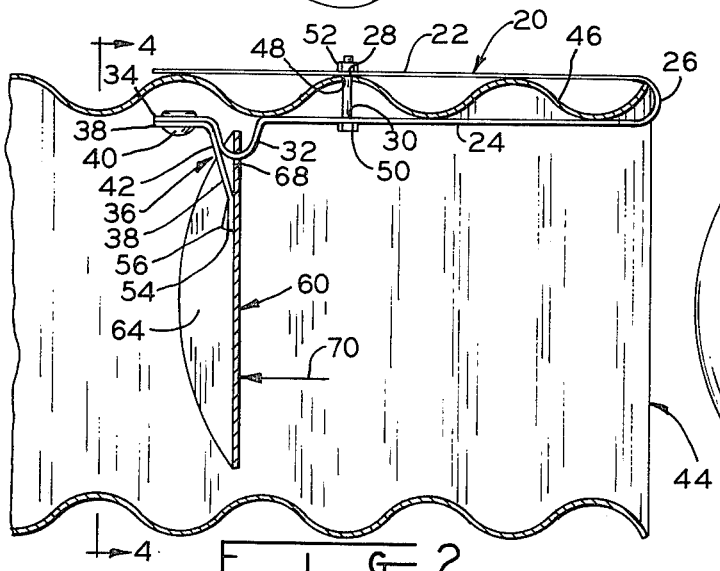
FIG. 2 is a longitudinal section of the embodiment of FIG. 1 mounted on the open end of a corrugated field pipe and showing the baffle member in a substantially vertical animal entry prevention position.
Figure 3:
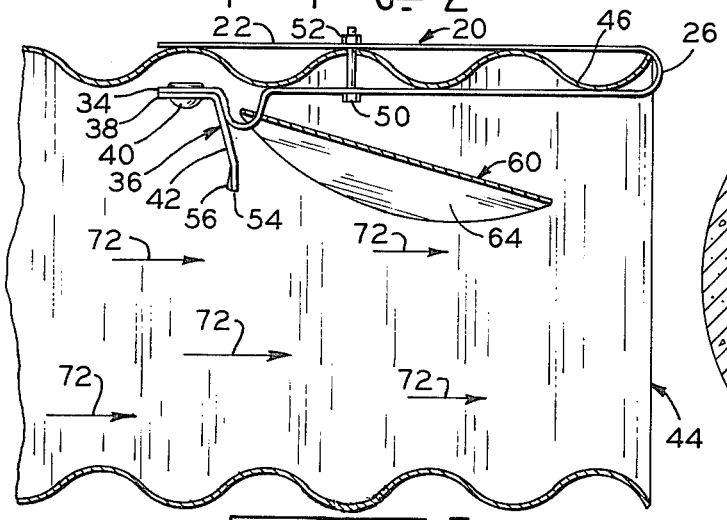
FIG. 3 is a section substantially similar to the section of FIG. 2 showing the baffle member pivoted to an open position for providing discharge of effluents.

Generally disc shaped baffle member 60 is folded along vertical diameter 62 thus dividing member 60 into halves 64, 66 on either side of diameter 62 having an obtuse included angle therebetween. Member 60 has oblong opening 68 adjacent the upper end of diameter 62 near the perimeter of member 60. Opening 68 is inserted over indent 32 for pivotally supporting member 60. End 54 of bar 38 is disposed inwardly of indent 32 and is vertically aligned with the nadir thereof. Corners 56, 58 of end 54 are engageable respectively with halves 64, 66 when member 60 is substantially vertically disposed. Member 60 is thus freely pivotable in a first arcuate direction to the open position, (FIG. 3), and restricted from pivotal movement in a second arcuate direction opposite to the first arcuate direction due to surface engagement of halves 64, 66 with corners 56 and 58 respectively of stop 36, (FIG. 2).

Corners 56 and 58 of end 54 of stop bar 36 are bent so that their surfaces have the same obtuse angle as is formed between halves 64 and 66 of member 60 so that there is a stabilizing surface contact between corners 56 and 58 and halves 64 and 66 respectively. Thus, upon a force on member 60 in the direction shown by arrow 70, (FIG. 2), as would be imparted by an animal trying to gain entry into pipe 44, member 60 is prevented from pivoting in the direction of arrow 70 beyond the position shown in FIG. 2, wherein it is substantially vertically disposed, due to the surface contact between corners 56 and 58 and halves 64 and 66 respectively and the reaction contact between member 60 and indent 32. Thus, animal entry from open end of pipe 44 is effectively prevented; however, when there is drainage flow of effluents, as shown by arrows 72 in FIG. 3, member 60 can pivot freely in the first direction to allow such flow to exit from the open end of pipe 44. Due to the fold of member 60 about diameter 62, a more complete pivoting of member 60 in the first direction is possible.

Thus, with a simple, inexpensive, stop member 36, the pivoting of member 60 in a clockwise direction, (FIG. 2), is effectively prevented thereby to prevent animal entry while member 60 is free to pivot in a counterclockwise direction, (FIG. 3), during effluent flow from pipe 44 toward the open end. In this invention, since stop bar 36 has a relatively small projection slanted substantially radially inwardly of pipe 44 and since its end is completely free of debris lodging crevices or constrictions, the guard is more easily maintained and longer-lived. Further, the length of stop bar 36 is less than one-half that of the diameter of baffle member 60. Minimal obstruction is presented to the flow of debris.

Figure 5:
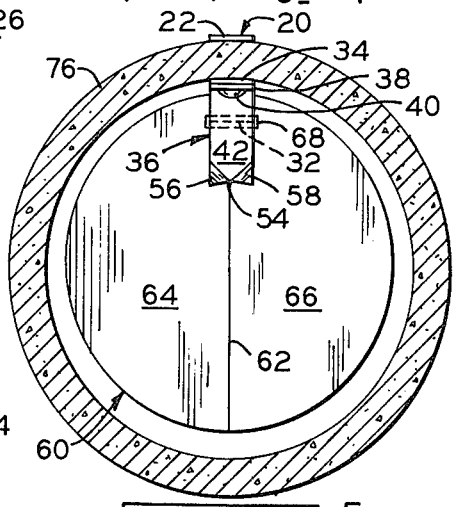
FIG. 5 is a section similar to the section of FIG. 4 showing the preferred embodiment mounted to a concrete field pipe.

This invention is also usable with concrete or clay field tile, as shown in the embodiment of FIG. 5, wherein field pipe 76 is concrete and receives upper leg 22 and lower leg 24 of retainer 20 at the uppermost perimetral portion of the open pipe end (FIG. 5). In this embodiment, a hole is not drilled through pipe 76 for insertion of a retaining bolt, the resiliency between legs 22 and 24 acting against the outer and inner surfaces of the pipe respectively, serving to hold retainer 20 securely in place during use of the invention.

In both embodiments, the diameter of disc 60 is slightly less than the diameter of pipe 44, 76 and is less than the predetermined distance between bight 26 and indent 32 so that animal manipulation of member 60 from the open end of pipe 44, 76 is inhibited.

While there have been described above the principles of this invention in connection with specific apparatus, it is to be clearly understood that this description is made only by way of example and not as a limitation to the scope of the invention.

What is claimed is:

1. In an animal guard for an elongated field pipe having a generally U-shaped member with elongated inner and outer legs each having a longitudinal axis connected by a bight portion and proportioned to be positioned over an open end of said pipe with said inner and outer legs extending axially of the pipe and respectively engaging the inner and outer surfaces thereof respectively; a generally circular baffle member formed of relatively thin sheet material pivotally suspended adjacent an upper perimetral portion thereof on said inner leg at a pivotal point thereon spaced a predetermined axial distance from said bight portion; said baffle member being vertically suspended from said point for pivotal movement in a first arcuate direction toward said inner leg and bight portion; an indented portion in said inner leg at said pivotal point; said baffle member having an oblong slot for receiving said indented portion to provide free pivotal movement between said inner leg and said member; the diameter of said baffle member being less than said predetermined distance; said baffle member being folded along a substantially vertical diameter to form a member half on either side of said diameter and having an obtuse fold angle between the member halves, said halves being inclined from said diameter in a direction away from said bight portion, the improvement comprising a stop member for preventing pivotal movement of said baffle member in the direction opposite said first direction; said stop member comprising an elongated bar with four corners and secured at a first end to said inner leg at a position thereon spaced from said bight portion a distance greater than said predetermined distance and extending lengthwise inwardly and downwardly from the axis of said inner leg; the other end of said bar having the inner corner portions thereof of folded construction and arranged to abut the surfaces of and to conform to said halves, said portions providing stabilizing surface contact with respective halves of said member when said member is pivoted in said opposite direction; said bar having a length to provide a stop for the pivotal movement of said baffle member in an arcuate direction opposite to said first arcuate direction thus preventing animal entry into said pipe past said member from said open pipe end, whereby said member is freely pivotable in said first direction to provide substantially free-flow of debris carrying effluents when mounted in said pipe towards said open pipe end; the length of said bar being less than one-half of the diameter of said baffle member.

2. The apparatus of claim 1 wherein said indented portion in said inner leg is arcuate at said pivotable point; said bar being inclined downwardly and forwardly toward said open pipe end so that said other end of said bar contacts said baffle member at a point substantially vertically and inwardly disposed from said indented portion thereby to limit the movement of said baffle member in said opposite arcuate direction beyond a vertical disposition, said indented portion being cooperable with said other end of said bar to provide a reaction point on said member when said member is urged in said opposite arcuate direction.

* * * * *